US005086571A

United States Patent [19]

Hietanen

[11] Patent Number: 5,086,571

[45] Date of Patent: Feb. 11, 1992

[54] DEVICE IN THE DRYING SECTION OF A PAPER MACHINE

[75] Inventor: Pekka Hietanen, Kyröskoski, Finland

[73] Assignee: Oy Tampella Ab, Tampere, Finland

[21] Appl. No.: 574,680

[22] Filed: Aug. 30, 1990

[30] Foreign Application Priority Data

Sep. 1, 1989 [FI] Finland ..... 894145

[51] Int. Cl.[5] ..... D06F 58/00

[52] U.S. Cl. ..... 34/117; 34/120

[58] Field of Search ..... 34/113, 114, 115, 116, 34/117, 118, 119, 120, 123

[56] References Cited

U.S. PATENT DOCUMENTS

| | | | |
|---|---|---|---|
| 4,502,231 | 3/1985 | Fissmann et al. . | |
| 4,669,198 | 6/1987 | Wedel | 34/117 |
| 4,677,763 | 7/1987 | Kotitschke et al. | 34/117 |
| 4,686,777 | 8/1987 | Cooke | 34/116 |
| 4,694,587 | 9/1987 | Eskelinen | 34/116 |
| 4,698,918 | 10/1987 | Kotitschke et al. | 34/117 |
| 4,698,919 | 10/1987 | Wedel | 34/117 |
| 4,821,429 | 4/1989 | Sieberth | 34/116 |
| 4,856,205 | 8/1989 | Meyer et al. | 34/117 |
| 4,881,327 | 11/1989 | Hauser et al. | 34/116 |
| 4,893,741 | 1/1990 | Heinzmann | 34/116 |

FOREIGN PATENT DOCUMENTS

WO87/06283 12/1986 PCT Int'l Appl. .

*Primary Examiner*—Henry A. Bennet
*Assistant Examiner*—Denise L. F. Gromada
*Attorney, Agent, or Firm*—Pollock, Vande Sande & Priddy

[57] ABSTRACT

In the drying section of a paper machine having a first cylinder, a second cylinder and a support fabric supporting a web to be dried, the fabric along with the web being passed from the first cylinder to the second cylinder, a device is provided at the height of the free run portion of the web and the support fabric between the cylinders on the side of the support fabric and comprises a chamber connected to a source of pressurized medium and a nozzle slot provided in the wall of the chamber for effecting a flow having an influence on positive and negative pressures induced in wedge-like spaces formed between the cylinders and the web with the support fabric for stabilizing the run of the web. The nozzle slot is directed at an angle with respect to the free run of the web and away from the web and the support fabric towards an area, which is outside the wedge-like space defined by the circumferential surface of the cylinder and the free run. The device further includes an ejector operatively connected with the nozzle slot. The ejector is adapted for ejecting air from a free space situated between the free run and the ejector. The ejecting of the air is induced by the flow path of the nozzle slot adjacent to the flow path of the ejector.

13 Claims, 1 Drawing Sheet

DEVICE IN THE DRYING SECTION OF A PAPER MACHINE

FIELD OF THE INVENTION

The present invention relates to a device in the drying section of a paper machine.

BACKGROUND OF THE INVENTION

The drying section of a paper machine comprises generally two tiers of drying cylinders, through which the web is passed, guided by a support fabric which carries it, the web and the support fabric running along a tortuous part alternately between the cylinders of the first tier and the second tier. At the drying cylinders of the first tier the web lies against the circumferential surface of the cylinder and the support fabric is situated on top of it, and at the cylinders of the second tier the web lies outermost while the support fabric lies against the circumferential surface. Consequently, at the location where the web leaves a cylinder of the first tier, and at the location where it enters a cylinder of the second tier, a wedge-like space is formed, in which due to the movements of the cylinders and the support fabric some phenomena causing problems in the run of the web are present. These phenomena are of greater importance as the work speeds of the paper machines have increased. At the location where the web leaves the cylinder of the first tier a negative pressure develops in the wedge-like space situated adjacent to the first cylinder. The subpressure tends to lift the web out of contact with the support fabric. Furthermore, a positive pressure develops in the wedge-like space located at the joining point between the cylinder of the second tier and the support fabric on the opposite side of the web and the support fabric. The positive pressure tends further to keep the web separated from the support fabric wrapping round the second cylinder. This causes edge flutter and torsion in the paper web and creates risks of tearing and wrinkling of the web which is being dried.

It is common to attempt to counteract the above mentioned harmful positive and negative pressures with the help of boxes provided along the free run portion of the web and the support fabric between a first tier cylinder and a second tier cylinder. The aim is to guide the air by means of air streams issuing from the boxes so that the air streams so generated would be opposite to the air streams that give rise to the positive and negative pressures. The boxes of this type are usually positioned on the side of the support fabric at the free run portion so that they can have an influence both on the wedge-like space situated on the other side of the support fabric and on the wedge-like space situated on the same side of the support fabric. The blow boxes of the above mentioned type have been disclosed, for example, in Finnish Patent No. 72547 and in International Patent Application PCT/US86/00745 (Publication No. WO 87/06283). The above mentioned boxes comprise as a rule a chamber connected to a source of pressurized medium, such as air, as well as a nozzle slot in the wall of the chamber for producing the air stream affecting the positive and negative pressures within the wedge-like spaces. A common drawback of the blowing boxes shown in the above mentioned publications and of other well-known blow boxes is that the nozzle slots are directed either against the directions of movements of the support fabric or against the circumferential surfaces of the cylinders. Hence, great blowing efficiency is necessary in order to produce a satisfactory result.

SUMMARY OF THE INVENTION

The purpose of the invention is to provide a device which does not have the drawbacks caused by the technique described hereinabove. For achieving this purpose the device according to the present invention is designed such that the nozzle slot is directed to be at an angle with respect to the free run of the web away from the web and the support fabric, towards an area which is situated outside the wedge-like space bounded by the circumferential surface of the cylinder and by the free run, such that it is possible to produce a considerable effect with a small blowing power due to the fact that associated with the nozzle slot there is an ejector for ejecting air from a space situated between the free run and the ejector.

The nozzle slot is directed preferably at an angle of 45° to 90° with respect to the free run. The device can easily be accommodated within the narrow pocket formed by two drying cylinders of the first tier and a drying cylinder of the second tier by using the configuration where the outer chamber wall facing the support fabric bounds the space situated between the ejector and the free run. The ejector structure can be created in the simplest way by forming the nozzle slot by means of two nozzle slots situated adjacent to each other substantially parallel to with each other, whereby the ejector structure is formed between the adjacent edges of the nozzle slots. The effect of the space between the support fabric and ejector can be improved by closing the space by sealing means.

The invention will be described in the following in more detail with reference to the accompanying drawing, wherein

BRIEF DESCRIPTION OF THE DRAWINGS

FIG. 1 shows a part of the drying section of the paper machine. The drying section comprises upper cylinders 1 and lower cylinders 2 aligned in two tiers. A web W and a support fabric F carrying it, a dryer felt, travel one on top of the other along a tortuous path between the upper cylinders and the lower cylinders. In the case of FIG. 1 the upper cylinders constitute the first tier, where the paper web W to be dried lies against the circumferential surface of the cylinders 1 and the support fabric F, the dryer felt, lies topmost supporting the web against the circumferential surface of the cylinder. The lower cylinders constitute the other tier, where the support fabric F lies against the circumferential surface of the cylinders 2 and the web W is situated topmost.

Figure 1:
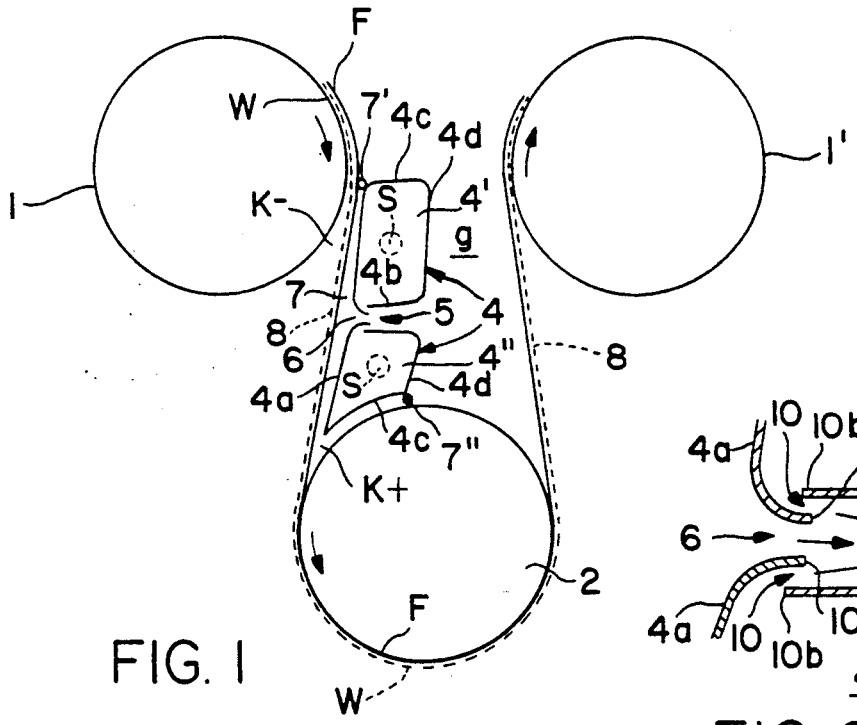
FIG. 1 shows a device according to the present invention in a sectional view taken perpendicularly to the axes of the drying cylinders.
Figure 2:
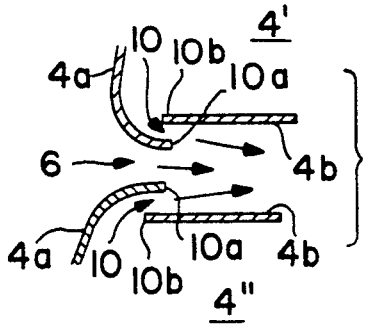
FIG. 2 shows the construction of the ejector of the device according to the invention in a larger scale.

In the following the events occuring in the direction of travel between two successive cylinders are described in more detail. The support fabric F and the web W leave a first tier cylinder 1, the first cylinder, for a second tier cylinder, the second dryer cylinder 2, at which the support fabric F is situated against the circumferential surface of the cylinder and the web travels on top of the support fabric. Between the cylinders 1 and 2 the web along with the support fabric travel as a free run, which has been indicated by reference numeral 8. A wedge-like space between the free run 8 and the circumferential surface of the cylinder 1 at the location where the web and the support fabric depart is indicated by letter K−. This space is subjected to negative pressure induced by the air streams caused by the movement of the cylinder 1 and the free run 8. Correspondingly, a wedge-like space at the point of junction of the web with the support fabric and the second cylinder 2, situated between the free run 8 and the cylinder 2, is indicated by letter K+. This space is subjected to positive pressure due to the movement of the above mentioned members.

A device 3 according to the invention is positioned at the height of the free run 8 on the side of the support fabric F. The device comprises a chamber 4 connected to a source S of pressurized medium, such as pressurized air, and it comprises further a nozzle slot 5 in the chamber wall. The nozzle slot 5 is directed at an angle with respect to the free run 8 of the web W and the support fabric F, that is in such a manner that the air stream issuing from the nozzle slot is directed away from the web and the support fabric at an angle with respect to the free run 8. The air stream, which is denoted by arrows in the Figure, is moreover directed towards an area 9, which is situated outside the wedge-like space K+ bounded by the cylinder 2 on the side of the device 3 and by the free run 8. Hence, the air stream does not need to overcome the currents caused by the rotatory movement of the cylinder.

Associated with the nozzle slot 5 there is an ejector 6 for ejecting air from a space 7 with the help of the air stream issuing from the nozzle slot. The space 7 is situated behind the ejector 6 and it is bounded by the free run 8. The negative pressure induced in the space 7 can thus have an effect on the positive pressure of the wedge-like space K+ on the same side of the free run 8, as well as on the subpressure in the wedge-like space K− on the other side of the free run 8, thus stabilizing the run of the web W.

After the web W and the support fabric F have travelled around the second cylinder 2 within a predetermined sector, which usually is over 180°, they leave it to form again a free run 8 and join again a cylinder situated in the same tier as the first cylinder 1. This cylinder is indicated by reference numeral 1' in Fig 1. The device 3 is thus situated within a pocketlike space bounded by the free run 8 arriving at the second cylinder 2, by the circumferential surface of the second cylinder 2 and by the free run 8 leaving the second cylinder 2. This space can be equipped for example with baffle plates for guiding the air stream issuing from the nozzle slot 5 further through the space between the first tier cylinders 1 and 1'.

In the following the construction of the device 3 is described in more detail.

The chamber 4 is constituted of two chambers 4' and 4'', which are situated along the width of the web to be dried perpendicularly to the direction of travel of the free run 8. Both chambers are connected in a suitable fashion, for example at their ends, to the source of pressurized air and they comprise each a nozzle slot 10 for the outlet of air. The nozzle slots 10 are situated adjacent to each other and form together the nozzle slot 5 directed in the abovementioned manner. The outer wall **4*a* of each of the chambers 4; 4 faces the support fabric F, bounding in this way substantially the free space 7 between the free run 8 and the ejector 6. The edges of the walls 4*a* of both chambers which are in the proximity of each other turn approximately at the mid portion of the free run 8 away from it, and in this direction they form a converging slot 6, which constitutes the ejector. The lower edge 10*a* of the wall 4*a* of the upper chamber 4' turning away forms at the same time one of the edges of the nozzle slot 10 of the upper chamber. The upper edge of the wall 4*a* of the lower chamber 4'' turning away forms at the same time the other edge 10*a* of the nozzle slot 10 of this chamber. A converging flow slot 6 for the air stream taking place away from the space 7 is thus formed between the adjacent edges 10*a* of the nozzle slots 10** in separate chambers.

The chambers 4' and 4'' further have outer walls **4*b* lying opposite to each other. The edges 10*b* of the walls 4*b* directed towards the free run 8 each form the other edge of the nozzle slot 10 of the respective chamber. This edge protrudes in both nozzle slots slightly beyond the opposite edge 10*a* of the nozzle slot, as seen in a plane which is parallel to the plane of the free run 8. The outer walls 4*b* facing each other diverge from each other starting from the nozzle slots 10 and form in this way therebetween a flow path widening in the flow direction for the flow issuing from the nozzle slots 10 and the ejector 6. This flow enters into the space 9 at a location, which is outside a plane which is tangent to the circumferential surface of the cylinder 2 at the midpoint of a sector thereof free from the web and the support fabric. The chamber front walls 4*d* bounding the chambers towards the space 9 join the opposite walls 4*b* at the remote ends of the walls 4*b*, as seen in the flow direction. At the lower end of the lower chamber 4'' next to the circumferential surface of the cylinder 2, the lower wall 4*c* following in an arcuate configuration the circumferential surface of the cylinder joins the front wall 4*d*. The lower wall 4*c* is thus situated between the rear wall 4*a* and the front wall 4*d*. The upper wall 4*c* interconnecting the front wall 4*d* and the rear wall 4*a* joins the upper edge of the front wall 4*d* of the upper chamber 4'. The upper wall 4*c* situated approximately at the height where the free run 8 leaves the cylinder 1. The construction of the device as far as the ejector and the nozzle slots is concerned is shown in a larger scale in FIG. 3**.

FIG. 1 further shows, how the space 7 is closed by means of a sealing means 7' fixed on one of the outer walls of the upper chamber 4'. The sealing means 7' is in contact with the support fabric F and is situated preferably at the location where the support fabric along with the web leave the cylinder 1 or before that location. In a like manner the space 7 is at the opposite end thereof closed with a similar sealing means 7'' situated between the outer wall of the lower chamber 4'' and the circumferential surface of the second cylinder 2 and being in contact with said surface. The sealing means can be any kind of previously known sealing means, for example mechanical sealing members, the purpose of which is to prevent the surface layer streams induced by the support fabric and the cylinders from entering into space 7, which phenomenon would impair the effect of the ejector 6.

Figure 3:
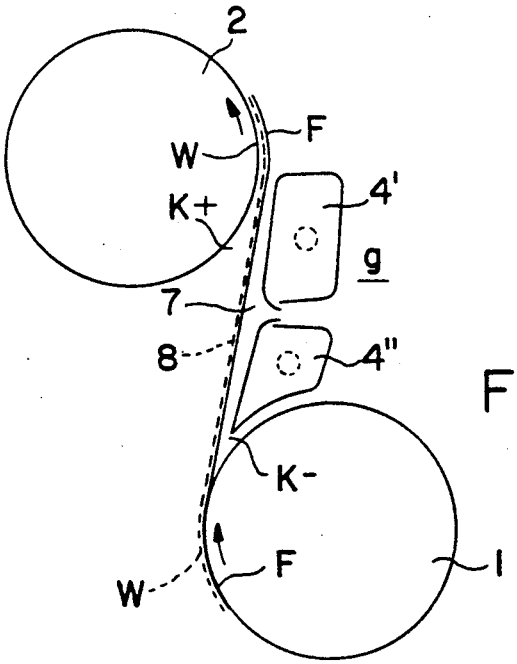
FIG. 3 shows an alternative embodiment of the device in a view similar to that of FIG. 1.

FIG. 3 also shows a realization of the device 3 in accordance with the invention. The situation of the chambers, the nozzle slots and the ejector with respect to the free run of the web W and the support fabric F is similar to that of FIG. 1. A difference lies in that in this case the cylinder of the second tier of dryer cylinders is the first cylinder 1 as seen in the direction of travel of the web and the support fabric. At this cylinder the web W travels on top of the support fabric F lying against the circumferential surface of the cylinder 1, whereafter they leave the first cylinder 1 and after the free run 8 join to a cylinder of the first tier of dryer cylinders, in this case the second cylinder 2, on which the web W is carried against the circumferential surface of the cylinder and the support fabric F lies topmost. The wedge-like space situated on the side of the support fabric F between the free run 8 and the cylinder 1 is the space K− where negative pressure prevails, and the space between the second cylinder 2 on the side of the web is the wedge-like space K+ where positive pressure prevails. The device 3 is situated in the same manner on the side of the support fabric F at the height of the free run 8, and also in this case the space 7 situated between the chambers 4 and 4'' and the support fabric F is affected by means of the ejector 6. Because at this location usually a smaller effect on the spaces K+ and K− is needed, the space 7 is not closed with sealing means of FIG. 1, but the space 7 is open both between the first cylinder 1 and the lower chamber 4'' and between the second cylinder 2 and the upper chamber 4'.

It should be noted that the drying section can comprise, in addition to the actual dryer cylinders, also other cylinders, so-called reversing rollers, which are not heatable, but are used for reversing the travel of the web and the support fabric into an opposite direction. They can be situated in the same locations as the cylinders 1 and 2 of FIGS. 1 and 3. It is apparent that the invention is suitable for use also in the drying sections comprising such cylinders.

I claim:

1. A device provided in the drying section of a paper machine having a first cylinder, a second cylinder and a support fabric supporting a web to be dried, said fabric along with the web being passed from the first cylinder to the second cylinder, said device being provided at the height of the free run portion of the web and the support fabric between the cylinders on the side of the support fabric, said device comprising:

a chamber connected to a source of pressurized medium and a nozzle slot provided in the chamber wall for effecting a flow having an influence on positive and negative pressures induced in wedge-like spaces formed between the cylinders and the web with the support fabric for stabilizing the run of the web, said nozzle slot being directed at an angle with respect to the free run of the web and away from the web and the support fabric towards an area, which is outside the wedge-like space defined by the circumferential surface of the cylinder and said free run, said device further including an ejector operatively connected with the nozzle slot, said ejector being adapted for ejecting air from a free space situated between said free run and said ejector, the ejecting of said air being induced by the flow path of said nozzle slot adjacent to the flow path of said ejector.

2. A device as claimed in claim 1, wherein the nozzle slot is directed at an angle of 45° to 90° with respect to said free run.

3. A device as claimed in claim 1, wherein said free space between said ejector and said free run is defined by the outer wall of the chamber facing said support fabric.

4. A device as claimed in claim 1, wherein said nozzle slot is formed of two adjacent nozzle slots situated substantially parallel to each other, and said ejector structure is formed between the adjacent edges of said nozzle slots.

5. A device as claimed in claim 4, wherein both nozzle slots have their own chambers and the ejector structure separates said chambers from each other.

6. A device as claimed in claim 1, wherein the nozzle slot is situated perpendicularly with respect to the direction of travel of the web and the support fabric substantially at the mid portion of said free run.

7. A device as claimed in claim 1, wherein on the first cylinder the support fabric supports the web from above and on the second cylinder the web is carried on top of the support fabric, and wherein said free space bounded by the outer wall of said chamber lying opposite to the support fabric is closed with sealing means being in contact with the support fabric at the location of the first cylinder in contact with the circumferential surface of the second cylinder.

8. A device as claimed in claim 1, wherein on the first cylinder the web is carried on the support fabric and on the other cylinder the support fabric supports the web from above, and wherein said free space bounded by the wall of said chamber lying opposite to the support fabric is open.

9. A device as claimed in claim 2, wherein the space between the ejector and said free run is defined by the outer wall of the chamber facing the support fabric.

10. A device as claimed in claim 3, wherein the nozzle slot is formed of two adjacent nozzle slots situated substantially parallel to each other, and the ejector structure is formed between the adjacent edges of the nozzle slots.

11. A device as claimed in claim 5, wherein the nozzle slot is situated perpendicularly with respect to the direction of travel of the web and the support fabric substantially at the mid portion of said free run.

12. A device as claimed in claim 6, wherein on the first cylinder the support fabric supports the web from above and one the second cylinder the web is carried on top of the support fabric, and wherein the space bounded by the outer wall of said chamber lying opposite to the support fabric is closed with sealing means being in contact with the support fabric at the location of the first cylinder or in contact with the circumferential surface of the second cylinder.

13. A device as claimed in claim 7, wherein, on the first cylinder the web is carried on the support fabric and on the other cylinder the support fabric supports the web from above, and wherein the space bounded by the wall of said chamber lying opposite to the support fabric is open.

* * * * *